US009076391B2

(12) United States Patent
Johnson et al.

(10) Patent No.: US 9,076,391 B2
(45) Date of Patent: Jul. 7, 2015

(54) HIGH DYNAMIC RANGE DISPLAY WITH REAR MODULATOR CONTROL

(75) Inventors: Lewis Johnson, Delta (CA); Jon Scott Miller, Harleysville, PA (US); Christopher Orlick, Washington Crossing, PA (US); Jerome Shields, Lumberton, NJ (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 332 days.

(21) Appl. No.: 13/123,567

(22) PCT Filed: Oct. 2, 2009

(86) PCT No.: PCT/US2009/059340

§ 371 (c)(1),
(2), (4) Date: Apr. 11, 2011

(87) PCT Pub. No.: WO2010/045038

PCT Pub. Date: Apr. 22, 2010

(65) Prior Publication Data

US 2011/0193895 A1 Aug. 11, 2011

Related U.S. Application Data

(60) Provisional application No. 61/105,412, filed on Oct. 14, 2008.

(51) Int. Cl.

| | |
|---|---|
| ***G09G 5/10*** | (2006.01) |
| ***G09G 3/34*** | (2006.01) |
| *G09G 3/36* | (2006.01) |

(52) U.S. Cl.

CPC ..... *G09G 3/3426* (2013.01); *G09G 3/3611* (2013.01); *G09G 2320/0238* (2013.01); *G09G 2320/0646* (2013.01); *G09G 2340/0407* (2013.01); *G09G 2360/16* (2013.01)

(58) Field of Classification Search

CPC ..... G09G 3/3426; G09G 2320/0646; G09G 2360/16

USPC ..... 345/690

See application file for complete search history.

(56) References Cited

U.S. PATENT DOCUMENTS

| | | | |
|---|---|---|---|
| 7,064,740 | B2 | 6/2006 | Daly |
| 7,403,332 | B2 | 7/2008 | Whitehead |

(Continued)

FOREIGN PATENT DOCUMENTS

| | | |
|---|---|---|
| EP | 1453030 | 9/2004 |
| EP | 1927974 | 6/2008 |

(Continued)

OTHER PUBLICATIONS

Li, et al., "66.1: Distinguished Student Paper: Deriving LED Driving Signal for Area-Adaptive LED Backlight in High Dynamic Range LCD Displays" SID 2007, 2007 SID International Symposium Society for Information Display, Los Angeles, USA. vol. XXXVIII, May 20, 2007, pp. 1794-1797.

(Continued)

*Primary Examiner* — Claire X Pappas
*Assistant Examiner* — Robert Stone

(57) ABSTRACT

Embodiments of the invention relate generally to computer-based image processing, and more particularly, to systems, computer-readable mediums, methods, and apparatuses to operate a rear modulator in a high dynamic range display to, among other things, characterize input images into pixel characteristics which may be data-reduced representations of a group of pixels corresponding to the input image, and to relate a modulation value intensity image to a weighted combination of the pixel characteristics. The modulation value intensity image may be used to derive a rear modulator drive signal, which, turn, may be configured to control one or more modulating elements to generate a low resolution image of the input image at the rear modulator.

20 Claims, 9 Drawing Sheets

(56) References Cited

U.S. PATENT DOCUMENTS

| | | | | |
|---|---|---|---|---|
| 7,830,358 | B2 | 11/2010 | Seetzen | |
| 7,872,659 | B2 | 1/2011 | Seetzen | |
| 2003/0090455 | A1 | 5/2003 | Daly | |
| 2005/0083295 | A1 | 4/2005 | Daly | |
| 2005/0083296 | A1 | 4/2005 | Daly | |
| 2005/0088400 | A1 | 4/2005 | Daly | |
| 2005/0088401 | A1 | 4/2005 | Daly | |
| 2005/0088402 | A1 | 4/2005 | Daly | |
| 2005/0162737 | A1* | 7/2005 | Whitehead et al. | 359/454 |
| 2005/0248553 | A1 | 11/2005 | Feng | |
| 2005/0248554 | A1* | 11/2005 | Feng et al. | 345/204 |
| 2005/0248593 | A1* | 11/2005 | Feng et al. | 345/690 |
| 2006/0103621 | A1 | 5/2006 | Feng | |
| 2006/0109234 | A1 | 5/2006 | Hong | |
| 2006/0215044 | A1* | 9/2006 | Masuda et al. | 348/224.1 |
| 2006/0290648 | A1 | 12/2006 | Yun | |
| 2007/0152954 | A1 | 7/2007 | Daly | |
| 2007/0159450 | A1 | 7/2007 | Daly | |
| 2007/0159451 | A1 | 7/2007 | Daly | |
| 2007/0216311 | A1* | 9/2007 | Cernasov et al. | 315/3 |
| 2007/0268577 | A1* | 11/2007 | Whitehead et al. | 359/443 |
| 2007/0285382 | A1 | 12/2007 | Feng | |
| 2008/0150853 | A1 | 6/2008 | Peng | |
| 2008/0180465 | A1* | 7/2008 | Whitehead et al. | 345/694 |
| 2008/0180466 | A1 | 7/2008 | Whitehead | |
| 2008/0204479 | A1 | 8/2008 | Seetzen | |
| 2009/0073108 | A1* | 3/2009 | Gorog | 345/102 |
| 2009/0096710 | A1* | 4/2009 | Raman et al. | 345/1.1 |
| 2009/0267926 | A1* | 10/2009 | Seo et al. | 345/204 |
| 2010/0182660 | A1* | 7/2010 | Mimoune | 358/518 |
| 2011/0033117 | A1* | 2/2011 | Sagawa | 382/199 |

FOREIGN PATENT DOCUMENTS

| | | |
|---|---|---|
| WO | 2009054223 | 4/2009 |
| WO | 2010/045039 | 4/2010 |

OTHER PUBLICATIONS

Lin, et al., "39.4: Inverse of Mapping Function (IMF) Method for Image Quality Enhancement of High Dynamic Range LCD TVs" SID 2007 International Symposium Society for Information Display, Los Angeles, USA, vol. XXXVIII, May 20, 2007, pp. 1343-1345.

Trentacoste, Matthew, "Photometric Image Processing for High Dynamic Range Displays" The University of British Columbia, Jan. 2006, a Thesis Submitted in Partial fulfillment of the requirements for the Degree of Master of Science.

Trentacoste, et al., "Photometric Image Processing for High Dynamic Range Displays" Science Direct, J.Vis. Commun. Image R. 18 (2007) 439-451.

* cited by examiner

HIGH DYNAMIC RANGE DISPLAY WITH REAR MODULATOR CONTROL

CROSS-REFERENCE TO RELATED APPLICATIONS

This application claims priority to U.S. Patent Provisional Application No. 61/105,412, filed 14 Oct. 2008, hereby incorporated by reference in its entirety.

FIELD

Embodiments of the invention relate generally to displaying images on High Dynamic Range displays, and more particularly, to systems, apparatuses, integrated circuits, computer-readable mediums, and methods to operate rear modulators to improve the dynamic range in imagery digitization.

BACKGROUND

High Dynamic Range (HDR) displays are typically formed from the optical combination of a Liquid Crystal Display (LCD) panel, and an array of individually controlled Light Emitting Diodes (LEDs) disposed behind the LCD panel. Pixel intensities are typically not controlled independently of each other because each LED overlaps many LCD pixels, and contributes to the brightness of the image displayed. In an HDR display, the contrast at the LCD panel is multiplied with the contrast at the array of LEDs, the result usually exceeding contrast ratios of 100,000:1.

Generally, common techniques to generate HDR images cause perceptual differences between the input image and the viewed image. While functional, various conventional approaches have drawbacks. In some approaches, common iterative solver algorithms have been used to calculate the set of LED driving intensities by solving a system of equations. Typical iterative solver algorithms process a relatively large number of pixels in the input image. As the number of pixels are greater than the number of LEDs, iterative solver algorithms often produce out-of-range values, and generate non-linear responses that led to abrupt changes in the light emitted by the array of LEDs between image frames. Such abrupt changes might result in a perceptible error. Conventional iterative solvers also attempted to prevent abrupt contrast in light emitted by the array of LEDs by focusing on edge-sharpening that might occur between image frames. But in doing so, these approaches have been complicated as they seek to solve for an ideal, "target" image at the array of LEDs.

In view of the foregoing, it would be desirable to provide systems, computer-readable mediums, methods and apparatuses to operate an array of LEDs of a HDR display by, among other things, controlling backlight illumination and LEDs as a function of an input image.

SUMMARY

Embodiments of the invention relate generally to computer-based image processing, and more particularly, to systems, computer-readable mediums, methods, and apparatuses to operate a rear modulator in a high dynamic range display to, among other things, characterize input images into pixel characteristics which may be data-reduced representations of a group of pixels corresponding to the input image, and to relate a modulation value intensity image to a weighted combination of the pixel characteristics. The modulation value intensity image may be used to derive a rear modulator drive signal, which, in turn, may be configured to control one or more modulating elements to generate a low resolution image of the input image at the rear modulator.

BRIEF DESCRIPTION OF THE FIGURES

The invention and its various embodiments are more fully appreciated in connection with the following detailed description taken in conjunction with the accompanying drawings, in which.

Like reference numerals refer to corresponding parts throughout the several views of the drawings. Note that most of the reference numerals include one or two left-most digits that generally identify the figure that first introduces that reference number.

DETAILED DESCRIPTION

Figure 1:
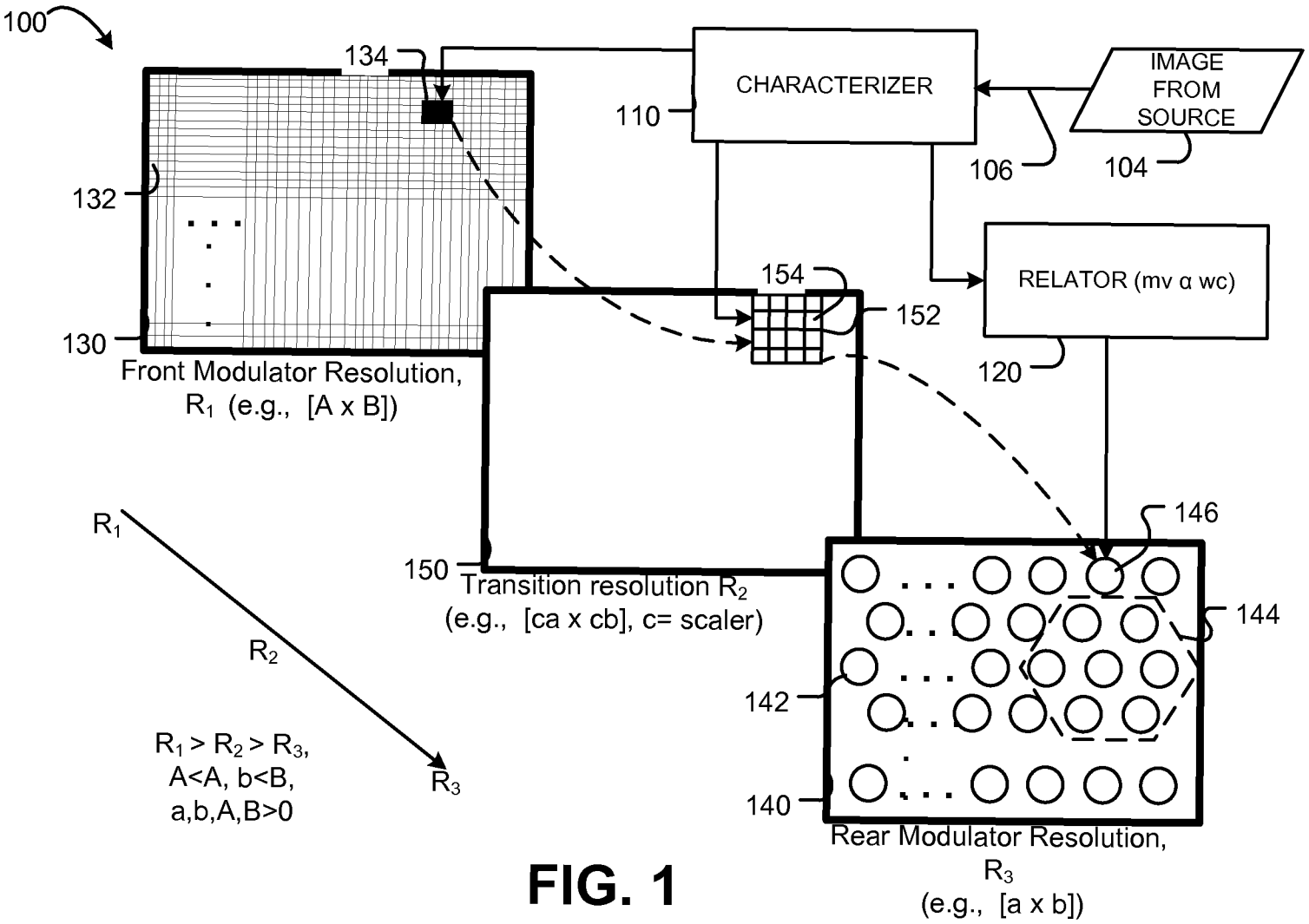
FIG. 1 is a diagram illustrating an exemplary process to operate a rear modulator, according to at least some embodiments of the invention.

FIG. 1 is a diagram illustrating an exemplary process to operate a rear modulator, according to at least some embodiments of the invention. Here, diagram 100 includes characterizer 110 and relator 120 that are configured to interact with data associated with representations 130, 140 and 150 to generate rear modulator drive signals (i.e., signal levels), such as backlight drive levels, for controlling one or more modulating elements (e.g., light sources, LEDs). Characterizer 110 can be configured to determine different pixel characteristics of the input image 104. Relator 120 can be configured to determine a representative image based on the pixel characteristics. An example of a representative image is a weighted combination intensity image of first and second pixel characteristics. The representative image can be used to generate a rear modulator drive signal to control operation of the rear modulator in a manner that preserves information about certain features in the input image 104. Such information can be used to preserve small features in darker regions that are to be captured by the rear modulator for illuminating the front modulator. In at least some embodiments, characterizer 110 may be configured to identify pixel characteristics from a group of pixels 134 as data-reduced representations of the group of pixels. Relator 120 may be configured to determine a modulation value intensity image based on the first and second pixel characteristics, the modulation value intensity image being associated with a group 152 of sample locations 154, which, in turn, correspond to the group of pixels 134. A signal that is indicative of a smooth modulation value intensity image may be applied to control one or more modulating elements 146 to generate a low resolution image based on input image 104 at the rear modulator. In some examples, first and second pixel characteristics may be applicable; while in other examples, fewer or more than two pixel characteristics may be applicable. Additionally, pixel characteristics can include data representing color, luminance, and the like.

In at least some embodiments, representation 130 includes a number of pixel samples that each correspond to a pixel for a front modulator, each pixel sample including pixel data (e.g., RGB information). The number of pixel samples for representation 130 can provide for a relatively high spatial resolution ($R_1$). Representation 140 may correspond to a rear modulator including a plurality of modulating elements 142 for generating light, at a lower spatial resolution ($R_3$) of input image 104, to illuminate the back of the front modulator. In at least one embodiment, representation 140 includes data representing drive values associated with modulating elements 142 disposed in a spatial arrangement (e.g., hexagonal 144, namely offset between rows). Representation 150 may correspond to a computer-simulated model of an intensity image at various spatial locations, the model of the intensity image being based on input image 104. Representation 150 can include a number of blocks, each block 152 corresponding to a group of pixels 134 and including a group of sample locations 154 (sub-blocks). The number of blocks 152 provides for a transitional spatial resolution ($R_2$), such that $R_3<R_2<R_1$. In some cases, the transitional spatial resolution $R_2$ provides an intermediate resolution between the number of pixels that are associated with representation 130, and the number of modulating elements 142 that are associated with representation 140. Further, the group of sample locations 154 may facilitate the display of fine features in darker regions of the input image 104 on the rear modulator, as well as specular highlights, and motion, among other image features. By cooperatively implementing the display of images on a rear modulator and a front modulator, at respective spatial resolutions, high dynamic range (HDR) images may be generated. An example of fine features includes image portions associated with a least one pixel, and an example of darker regions includes neighboring pixels that have negligible or zero amounts of image intensity.

In view of the foregoing, characterizer 110 can be configured to characterize input image pixels that, in some embodiments, are gamma-encoded on data line 106 and have a relatively high spatial resolution, $R_1$. However, characterizer 110 can be configured to characterize input image pixels at the transitional spatial resolution, $R_2$, which is lower than that of $R_1$. Thus, a reduction in image processing computation can be achieved, thereby reducing an amount of computational resources associated with generating the signal that is used to control illumination of modulating elements of the rear modulator. In particular, the pixel characteristics can be data-reduced representations for a group of pixels 134. In some cases, the pixel characteristics include maximum and mean intensity images extracted from the input image 104. In other cases, the pixel characteristics include maximum and mean luminance values derived from the input image 104. Relator 120 can be configured to generate a modulation value intensity image that is based on a weighted combination intensity image of the maximum and mean intensity images to represent a portion of an input image 104 in image space, but at the transitional spatial resolution $R_2$. As processing may be performed at a minimum resolution, that is, at $R_2$, fewer samples can reduce the computational processes and the complexity to determine rear modulator drive signals. With the description provided herein, acquiring, processing and displaying images on a rear modulator may be accomplished in a manner that accommodates various contrasts at the rear modulator.

Some exemplary examples may be described with respect to FIG. 1, in the context of a flow for a process to transform an input image 104 from a high spatial resolution into a low-resolution image to be generated by a rear modulator. Representation 130 has a resolution $R_1$ that can be represented by [A×B] pixels. In some examples, the corresponding front modulator may be operable when a pixel value at 0 corresponds to black, and when a pixel value at 1 corresponds to maximum transmittance. Representation 140 includes an array of modulating elements 142 that has a resolution $R_3$, that can be represented by [a×b] pixels, where $a<A$, $b<B$, and $a, b, A, B>0$. Although shown with a hexagonal configuration 144 of modulating elements 142, the corresponding rear modulator may in other examples have a quadrilateral-shaped configuration or any other configuration of modulating elements. In some embodiments, the resolution of the modulating elements 142 that are illuminated to form an image may be of a different spatial configuration relative to the spatial configuration of representations 130 and 150; and in such embodiments, linear scaling, interpolation, and other suitable techniques to transform the input image from either the spatial resolutions $R_1$ or $R_2$ to the spatial resolution $R_3$ may be employed by the rear modulator. In other embodiments, the input image 104 may have the same resolution as the image displayed on the front modulator, namely $R_1$. Additionally, input image 104 may be a video stream at 60 Hz, by way of some examples; while in other examples, input image 104 may be a video stream at 120 Hz. It will become apparent that further examples of input image rates may be acceptable. Input image 104 also may be transmitted to characterizer 110 as a gamma-encoded signal on line 106 in the image space.

The input image 104 may be downsampled to the transitional spatial resolution $R_2$ as shown in representation 150, for example, to simulate the size of the anticipated specular pattern. In representation 150, the downsampled image may be represented by ca×cb sub-blocks, where each image block 152 including sub-blocks 154 may correspond to the downsampled group of pixels 134, and where c represents a scaled integer. In order to obtain a signal to control one or more modulating elements 146 to generate a smooth image on the rear modulator, block 152 may be downsampled to modulating element 146, by way of example. The resolution $R_2$ may be a multiple of the resolution $R_3$ corresponding to the array of modulating elements 142, namely ca×cb. In some examples, c=2, so that the resolution $R_2$ is twice the resolution of $R_3$, namely $R_2$=[2a×2b]. It may be appreciated that in some examples, one modulating element 142 may be controlled individually; while in other examples, multiple modulating elements may be controlled collectively as group and depending upon the application.

Figure 2:
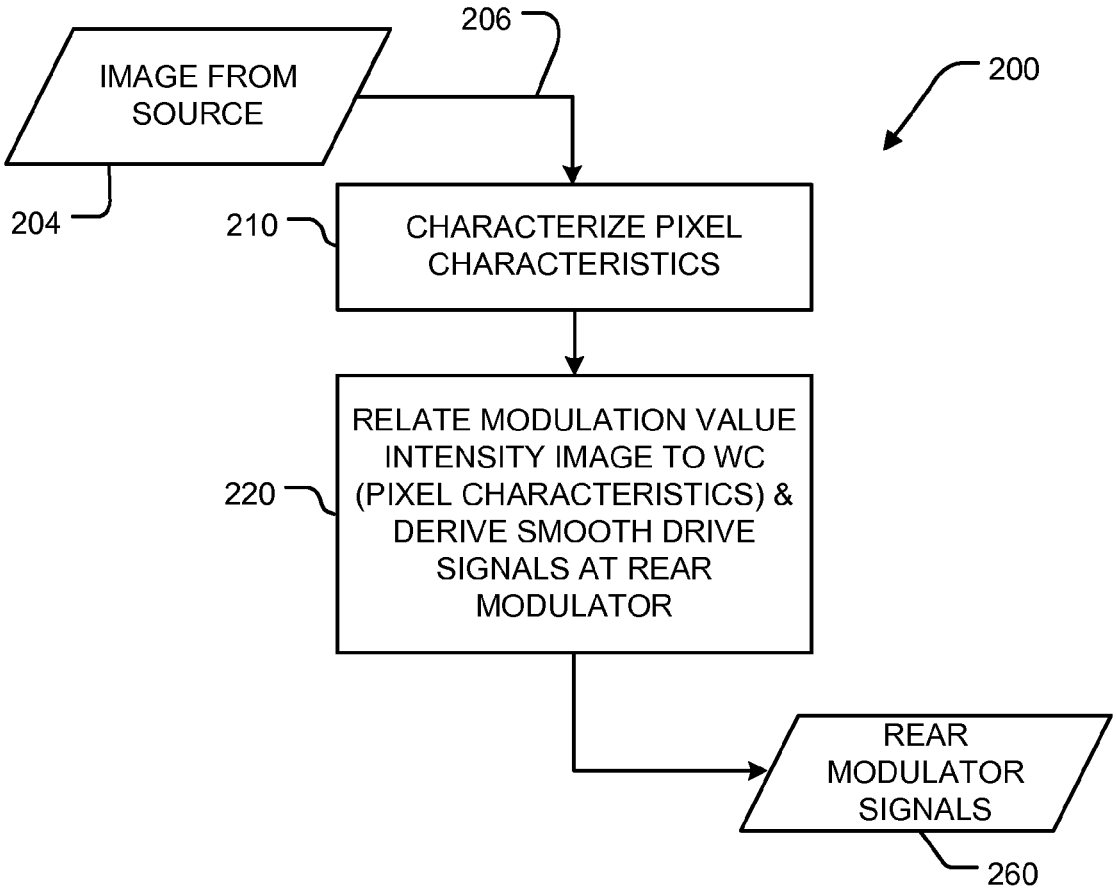
FIG. 2 illustrates a flowchart of an exemplary method to operate a rear modulator, according to at least some embodiments of the invention.

FIG. 2 illustrates a flowchart 200 of an exemplary method to operate a rear modulator, according to at least some embodiments of the invention. An input image 204, in some examples, may be represented as a gamma-encoded signal on data line 206 in the image space, received from an image source and characterized at 210. That is, pixel characteristics can be identified from the input image. At 220, a modulation value intensity image is determined according to a relationship with a weighted combination intensity image of the pixel characteristics, wherein the modulation value intensity image may be used to generate a rear modulator drive signal. This signal may be transmitted to control the operation of a rear modulator in a manner that preserves information about certain features in the input image, such as information directed to small features in darker regions to be captured by the rear modulator for illuminating the front modulator. At 260, rear modulator drive signals indicative of the modulation value intensity image may be applied to a rear modulator to control one or more modulating elements 142 to generate a low resolution image, such as a backlight image.

Figure 3:
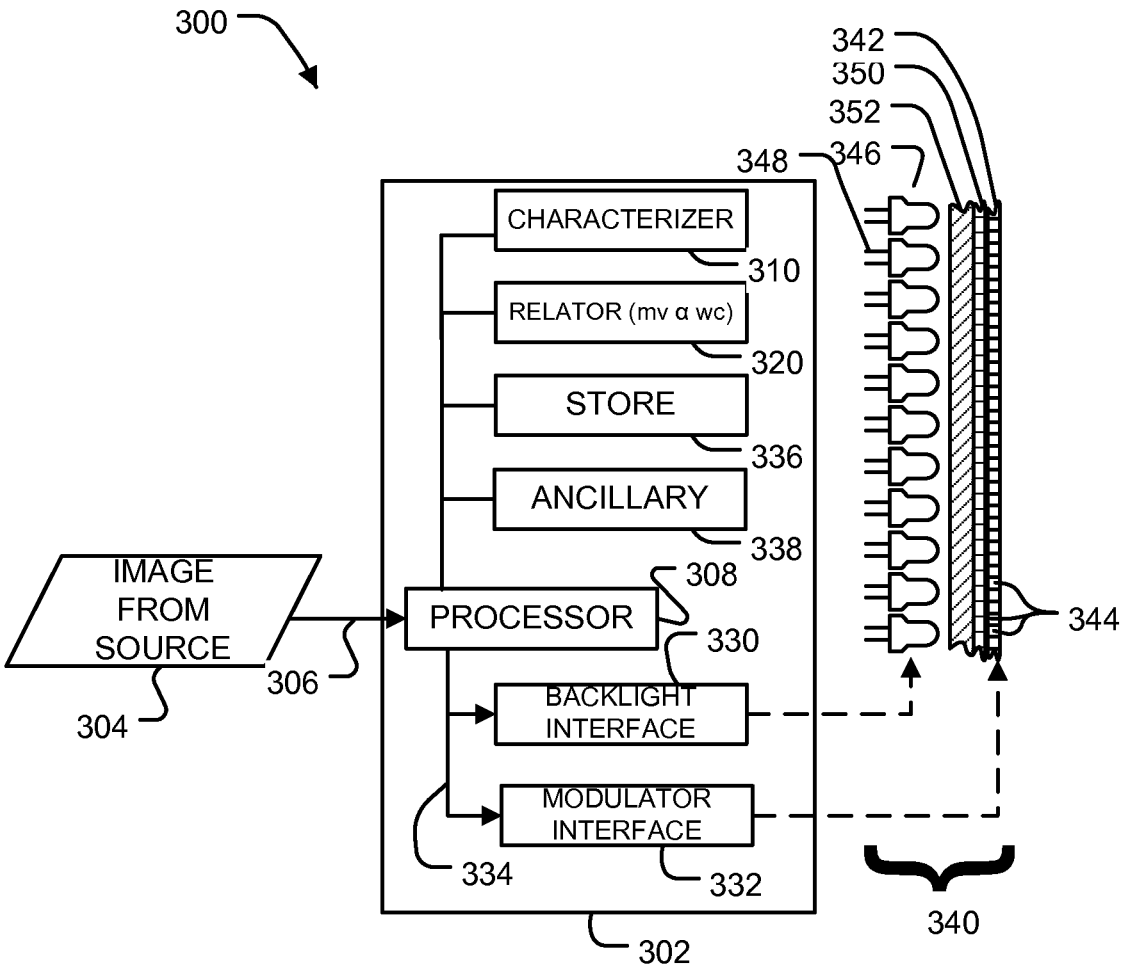
FIG. 3 is a schematic diagram of a controller configured to operate a display device having a rear modulator, according to at least some embodiments of the invention.

FIG. 3 is a schematic diagram of a controller configured to operate a display device having a rear modulator, according to at least some embodiments of the invention. System 300 includes a display controller 302 configured to be communicatively coupled to display device 340. Display controller 302 includes: processor 308; characterizer module 310; relator module 320; an interface 330 configured to control a rear modulator, such as a backlight interface; an interface 332 configured to control a front modulator; store 336; and, ancillary module 338. Bus 334 enables these modules and components of controller 302 to be communicatively coupled to each other, as illustrated. Processor 308 can be configured to receive input images 304 to be displayed on display device 340. In some examples, input images 304 may be a gamma-encoded video signal (e.g., video stream) transmitted on data line 306, and from which a group of image pixels may be derived. Characterizer module 310 can be configured to determine a first pixel characteristic and a second pixel characteristic as data-reduced representations of a group of pixels representing input images 304. Relator module 320 can be configured to determine a modulation value intensity image as a weighted combination intensity image of the first pixel characteristic and the second pixel characteristic. Store 336, which is accessible to processor 308, may include software instructions, that, when executed by processor 308, cause the methods and processes described herein to be performed. Ancillary module 338 can be configured, in some examples, to generate an alternative signal as an override to a rear modulator drive signal generated by backlight interface 330. This alternative signal may include a maximum value bypass to ensure that modulating elements of a rear modulator are illuminated partially when data representing input images is non-zero. For example, the alternative signal can provide a rear modulator drive signal having a minimal level of image intensity to display an image portion in a subset of pixels (e.g., representing small features) that otherwise would not be illuminated based on image intensity values of the other pixels (e.g., representing darker regions of the input image 304) in a group of pixels 134, to appear in the low resolution image displayed by a rear modulator. In other embodiments, the alternative signal may provide a rear modulator drive signal having a minimum level of image luminance.

Display device 340 may include a front modulator 342, a rear modulator 346, and optical structures 350, 352 configured to carry light from rear modulator 346 to front modulator 342. Front modulator 342 may be an optical filter of programmable transparency that adjusts the transmissivity of the intensity of light incident upon it from rear modulator 346. Rear modulator 346 can be configured to be a light source. In some examples, rear modulator 346 can be formed from one or more modulating elements 348, such as an array of LEDs, or one or more light sources. In some examples, front modulator 342 may comprise an LCD panel or other transmission-type light modulator having pixels 344. Front modulator 342 may be associated with a resolution that is higher than the resolution of rear modulator 346. In some examples, ancillary module 338 may determine and resolve a mismatch in spatial resolution between rear modulator 346 associated with $R_3$, and either the spatial resolution $R_1$ of a front modulator 342 or a transitional spatial resolution $R_2$, as described in FIG. 1. Optical structures 350, 352 may include elements such as, but not limited to, open space, light diffusers, collimators, and the like. In some examples, front modulator 342 and rear modulator 346 may be configured to collectively operate display device 340 as a HDR display.

Based upon input image 304, controller 302 is configured to provide rear modulator drive signals to control the modulating elements 348, and to control pixels 344 of front modulator 342 to collectively produce the desired image for viewing by a person or persons on display device 340. Although not shown, controller 302 may be communicatively coupled to a suitably programmed computer having software and/or hardware interfaces for controlling rear modulator 346 and front modulator 342 to display an image specified by data corresponding to input image 304. It may be appreciated that any of the elements described in FIG. 3 can be implemented in hardware, software, or a combination of these.

Figure 4A:
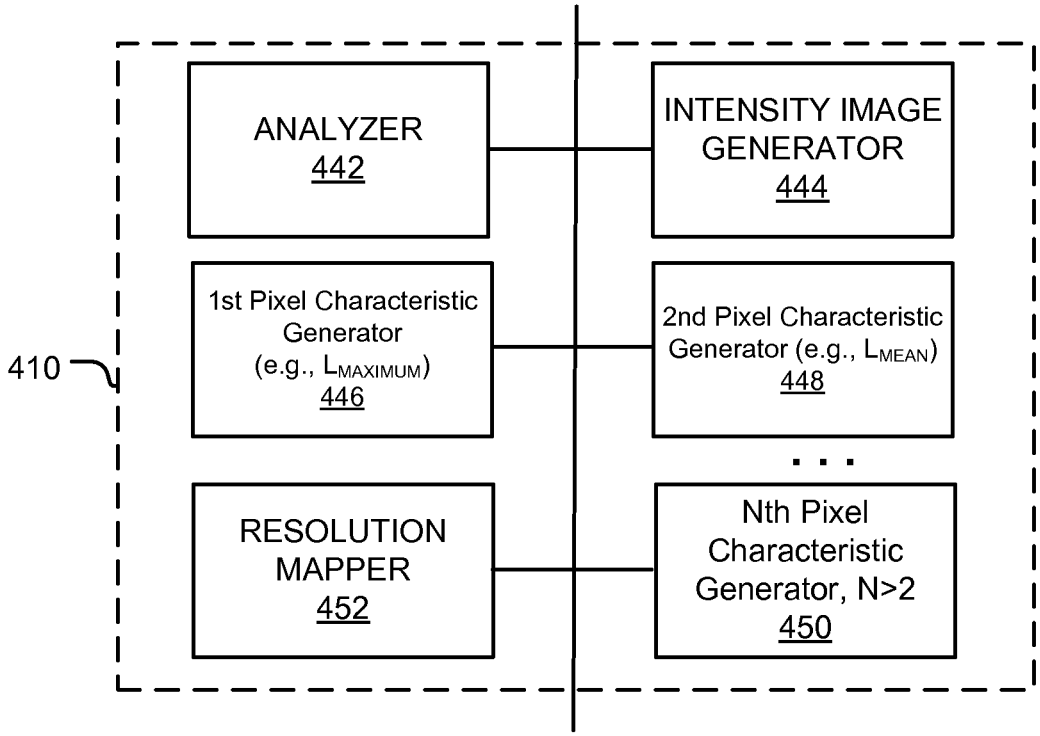
FIGS. 4A-B illustrate functional block diagrams of examples of a characterizer and a relator, respectively, that can be implemented in software and/or hardware, such an integrated circuit (IC) or Field Programmable Gate Array (FPGA), according to at least some embodiments of the invention.
Figure 4B:
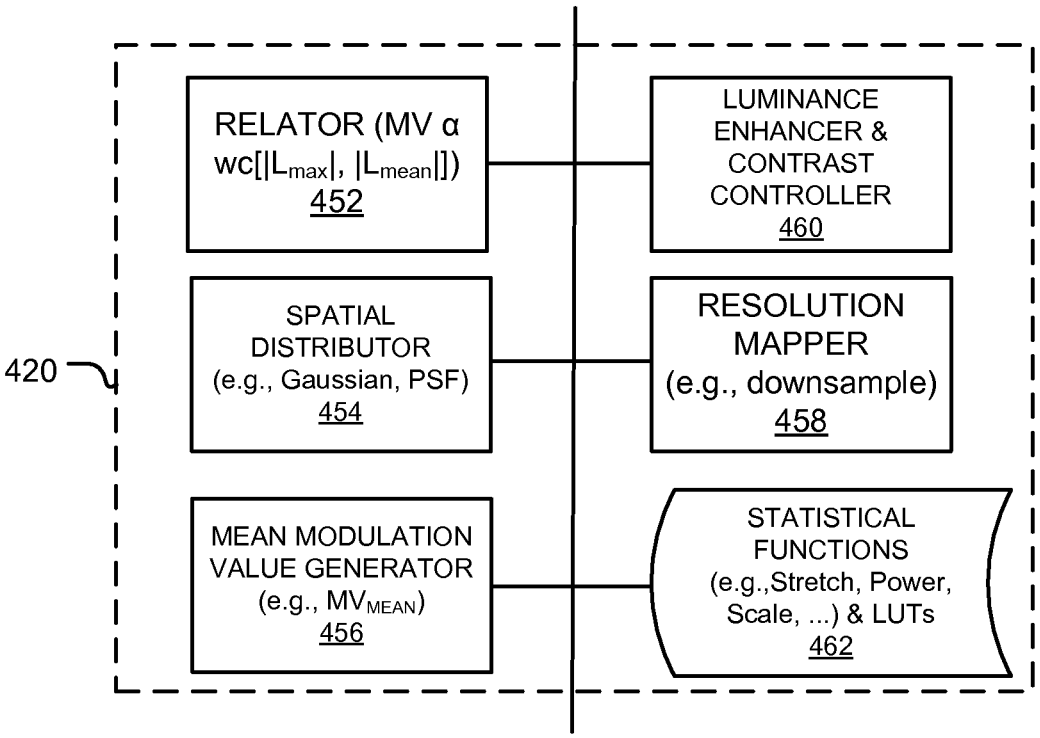

FIGS. 4A-B illustrate functional block diagrams of examples of a characterizer and a relator, respectively, that can be implemented in software and/or hardware, such an integrated circuit (IC) or Field Programmable Gate Array (FPGA), according to at least some embodiments of the invention. FIG. 4A illustrates that a characterizer 410 may include an analyzer 442, input intensity image generator 444, 1st-to-Nth pixel characteristic generators 446-450, where N>2 in some examples, and a resolution mapper 452. Analyzer 442 may be configured to analyze input images to identify pixel characteristics. In some examples, analyzer 442 may identify from input images, data representing 3 color channels such as red, green, and blue (RGB) of an input image pixel, a matrix transformation of color, or other similar color data. In other examples, analyzer 442 may determine luminance values for pixels of an input image. In still further examples, analyzer 442 may determine, for example, tristimulus values based on the input images, data representing the human visual system, and aspects thereof. Tristimulus values may include, but are not limited to, a set of X, Y, and Z values which may represent a three-component additive color model for matching a test color as derived from R, G and B colors, and as consistent with the CIEXYZ color space.

Intensity image generator 444 may accept the output of analyzer 442, and in turn, may establish an intensity image. In some examples where input images include a gamma-encoded video stream having three color channels, such as R, G and B, the intensity image may be selected in manner to minimize memory and processing requirements. One manner of reducing the input video stream from three channels to a single channel is to determine the maximum of the R, G and B input values L, per pixel according to Eq. (1).

$$L_{intensity}=\max(L_{red},L_{green},L_{blue}) \quad \text{Eq. (1)}$$

With Eq. (1), the reduction of the color input image to an intensity image, $L_{intensity}$, may in some examples reduce processing and memory requirements of hardware by approximately two-thirds. By selecting the intensity information of one channel, the bit-depth used to represent data during image processing may be economized. Furthermore, image processing performed in a non-linear space, as opposed to a linear space, may be further optimized. For example, image processing undertaken in non-linear image space may be accomplished using 8-bits in some examples; while in other examples, upwards of 30-bits may be used for image processing when undertaken in a linear space. It may be appreciated that a non-linear space may include, but is not limited to, a gamma-encoded image space, a logarithmic-encoded image space, an encoded image space based on one or more human visual system perceptual functions, and other image spaces associated with HDR input images. In other examples, the output of analyzer 442 may be luminance values derived from the input video stream, which in turn may be received by generator 444. In such examples, generator 444 may determine a maximum luminance for one or more color channels (e.g., R, G, B) for one or more pixels. In still further examples where rear modulating elements, such as 146, comprise white LEDs, it may be understood that an intensity image may be determined using similar principles of Eq. (1), but without applicability to color channels.

Resolution mapper 452 may receive as an input, the maximum intensity image determined by generator 444, and may map this input to a lower spatial resolution where image processing may be undertaken. In some embodiments, the mapping of maximum intensity image, $L_{intensity}$, may include a downsample to a block of sample locations at a reduced spatial resolution. With downsampling, the intensity image, $L_{intensity}$, may be mapped from a higher spatial resolution $R_1$ to a lower spatial resolution, such as $R_2$ as discussed with FIG. 1. In other embodiments, the intensity image, $L_{intensity}$, may be downsampled to two lower resolution images, $L_{max}$ and $L_{mean}$, where this lower resolution may also be referred to interchangeably as a working resolution. The working resolution represents a lower resolution where image processing may be undertaken to reduce computational requirements, and may be analogized to transitional spatial resolution $R_2$ discussed with respect to representation 150 of FIG. 1.

First pixel characteristic generator 446 may characterize a group of pixels 134 to form a first pixel characteristic as a data-reduced representation of the group of pixels. In one embodiment, generator 446 may establish a maximum intensity image $L_{max}$ for the first pixel characteristic according to Eq. (2).

$$L_{max}(i)=\max(L_{intensity}[\text{region}_i]), \quad \text{Eq. (2)}$$

where i corresponds to a sub-block 154 of an image block 152. In such examples, a pixel i in the lower resolution image (e.g., $R_2$) represents the maximum of the intensity images corresponding to the $i^{th}$ region in the intensity image, $L_{intensity}$. The first pixel characteristic, $L_{max}$, can be configured to represent small features in darker regions represented by a group of pixels 134. Such small features may correspond to an image portion in a subset of pixels within the group of pixels 134, where the subset of pixels may be located adjacent to other pixels in the group of pixels that have image intensities that are substantially zero, namely the darker regions of neighboring pixels.

Second pixel characteristic generator 448 may characterize a group of pixels 134 to form a second pixel characteristic as a data-reduced representation of the group of pixels. In one embodiment, generator 448 may establish a mean intensity image $L_{mean}$ for the second pixel characteristic according to Eq. (3).

$$L_{mean}(i)=\text{mean}(L_{intensity}[\text{region}_i]), \quad \text{Eq. (3)}$$

where i corresponds a sub-block (similar to that of sub-block 154) of an image block (similar to image block 152). In such examples, a pixel i in the lower resolution image (e.g., $R_2$) represents the mean of the intensity images corresponding to the $i^{th}$ region in the intensity image, $L_{intensity}$. The second pixel characteristic, $L_{mean}$, can be configured to represent an attenuation of an output of one or more modulating elements 146, thereby contributing temporal stability (e.g., to reduce or eliminate backlight motion artifacts) of the low resolution image to be displayed on the rear modulator.

The $\text{region}_i$ in Eqns. (2) and (3) corresponding to the original intensity image, that is, at resolution $R_1$, may be determined by the ratio between the resolutions of the input image and the working resolution. In some embodiments, the regions may not overlap so as to ensure that the light emitted by the modulating elements 142 remain constant for input images having movement of one or more features. While in some embodiments, two pixel characteristics may be generated; in other embodiments, more than two pixel characteristics may be generated depending upon the application, as the Nth pixel generator 450, N>2, depicts. Furthermore, it may be appreciated that other pixel characteristics may be identified by characterizer 410. In some examples, the first pixel characteristic may be defined as a maximum luminance characteristic corresponding to an image portion in a subset of pixels corresponding to fine features in the group of pixels. The subset of pixels may be located adjacent to other pixels in the group of pixels that have luminance values that are substantially zero to represent darker regions of neighboring pixels. In such examples, to obtain the mean luminance values, the average of all of the luminance values from those pixels within a group, such as 134, may be determined. Additionally, in other examples, the second pixel characteristics may be identified by characterizer 410 as a mean luminance characteristic corresponding to a degree of attenuation of an output of one or more modulating elements 142 (of FIG. 1). In these examples, to obtain the mean luminance value, the average of the luminance values for pixels within a group of pixels may be determined.

Referring to FIG. 4B, here, a relator 420 may include a relator module 452, spatial distributor 454, a mean modulation value generator 456, a resolution mapper 458, a luminance enhancer and contrast controller 460, and storage 457. Relator module 452 may be configured to determine a modulation value intensity image for a group 152 of sample locations 154 (FIG. 1) based on the maximum intensity image, $L_{max}$, and the mean intensity image, $L_{mean}$. In particular, relator module 452 may calculate the modulation value intensity image as a weighted combination intensity image (wc) of the first and second pixel characteristics. In some examples, the weighted combination intensity image of $L_{max}$ and $L_{mean}$, designated as Relator (MV $\alpha$ wc[$\|L_{max}\|$,$\|L_{mean}\|$]) may be defined according to Eq. (4):

$$wc=L_{combo}=jL_{max}+kL_{mean}, \text{ where } j+k=1. \quad \text{Eq. (4)}$$

In some examples, j and k are weighted coefficients that are normalized, such that the modulation value intensity image (MV) is related to the weighted combination intensity image of the first and second pixel characteristics according to a linear combination. According to one embodiment, j=0.25 and k=0.75. In other embodiments, the weighted coefficients may be chosen such that the modulation value intensity image is related to the $L_{combo}$ of first and second pixel characteristics according to a non-linear combination. In further examples, the weighted coefficients may be determined based on statistics applied to input image. In such examples, the coefficients j and k may be determined responsive to statistics describing any factor, characteristic, or value representing image approximation.

Figure 5:
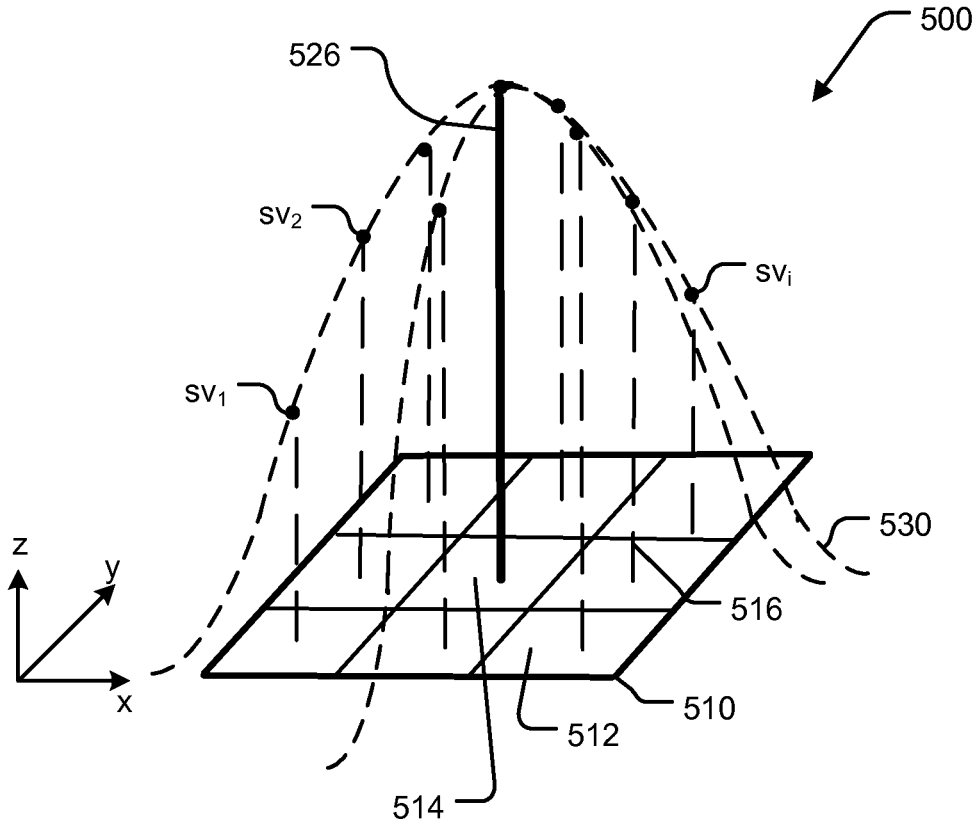
FIG. 5 depicts a spatially-distributed weighted combination intensity image, taken along the x, y and z coordinates of an image block.

FIG. 5 depicts a spatially-distributed $L_{combo}$, taken along the x, y and z coordinates of an image block. In the diagram 500, $L_{combo}$ in the shape of envelope 530, taken along the x, y, and z coordinates of image block 510, may be constructed. In some examples, spatial distributor 454 may spatially distribute $L_{combo}$ among a group (e.g., block 152) of sample locations (e.g., 154) to form at least a set of distributed values in representation 150 of FIG. 1. In other examples, a filter may be applied to spatially distribute values of $L_{combo}$ across a set of distributed values, $sv_1, sv_2, \ldots, sv_i$, among a group 510 of sample locations 512, where i>0. As shown, the set of distributed values are derived from impulses 516. Spatial aliasing from the rear modulator that leaks through the front modulator may be visible. In some examples, spatial aliasing may be addressed by applying a low-pass spatial filter to $L_{combo}$. The low-pass spatial filter may be configured to smooth gradients associated with the modulating elements 146, thereby spreading an artifact in the nature of a halo (i.e., caused by the leakage of rear modulator light through front modulator) symmetrically about a feature represented in the input image. In some examples, the mitigation of aliasing artifacts through the use of filtering may reduce the luminance of the halo to less than the veiling luminance of the human visual system (i.e., below which the human visual system may detect or perceive). In other examples, spatial aliasing components can change significantly from frame to frame as the image moves. With such examples, aliasing visibility for a moving image sequence may be much greater than for a single frame, and the level of anti-aliasing filtering (i.e., to mitigate aliasing artifacts) may be greater for moving images than stills. It will be understood that the filter can be adjusted to optimize the balance between rear modulator contrast and rear modulator aliasing for particular applications. In other examples, an approximate two-dimensional Gaussian distribution may be used as a filter kernel and convolved with $L_{combo}$ to derive a filtered rear modulator image, according to Eq. (5).

$$L_{filtered} = (1/16)\begin{vmatrix} 1 & 2 & 1 \\ 2 & 4 & 2 \\ 1 & 2 & 1 \end{vmatrix}(convolve)L_{combo} \qquad \text{Eq. (5)}$$

It may be appreciated that other variants of spatial distributors, and similar filters may be well-suited to achieve a filtered rear modulator image, $L_{filtered}$. In other embodiments, a filter may be applied to $L_{combo}$ to spatially distribute it across the set of distributed values to compensate the modulation value intensity image for an optical blur. Additionally, a filter may contribute to achieving a smoother image so that it represents the actual light field that would result when displayed at the rear modulator. In other examples, the shape of the filter may be adjusted to also smooth the image. In yet further examples, other image filtering techniques may be used to tune the rear modulator drive signal for the rear modulator. As shown in FIG. 5, sample location 514 happens to represent the spatial position of modulating element 146 at the rear modulator. It may be understood that the group 510 of 9 sample locations 512 was chosen for illustrative purposes.

The $L_{filtered}$ may be further downsampled, by resolution mapper 458 in FIG. 4B, to the resolution $R_3$ corresponding to one or more of the rear modulating elements 146 in order to establish the rear modulator drive signals. In some embodiments, a mean bilinear downsample may be applied by generator 456 and resolution mapper 458 to smooth the rear modulator low resolution image, as provided by Eq. (6).

$$L_{clusters}(i)=\text{mean}(L_{filtered}[\text{region}_i]). \qquad \text{Eq. (6)}$$

In some examples where the filtered image $L_{filtered}$ is at twice the resolution (e.g., $R_2$ at [2a×2b] pixels) of the rear modulating elements, a 2×2 region of rear modulating elements, also referred to as a cluster image, may be a group comprising modulating elements for which drive signals are derived by controller 302. The horizontal and vertical resolution of the rear modulating elements forming the rear modulator, may be referred to as the rear modulator clusters. Where the modulating elements are configured as an array of LEDs, reference may be made to the LED cluster resolution. In some examples where input values, although in the gamma-encoded space, range from zero to one, the corresponding cluster values may then be driven by rear modulator drive signals ranging from zero to one, where zero represents black and one represents the highest intensity level of a rear modulating element.

In some examples, generator 456 can be configured to calculate as the mean modulation value intensity image, $MV_{MEAN}$, that is, the average value of at least a subset of the distributed values, $sv_1, sv_2, \ldots, sv_i$, determined by spatial distributor 454. In some examples, the subset may include all of the distributed values, $sv_1, sv_2, \ldots, sv_i$, across image block 510; while in other examples, the subset may include fewer than all of the distributed values across image block 510.

Referring briefly back to FIG. 1, the spatial resolution of the array of modulating elements 142 disposed at a rear modulator, and as indicated by representation 140, may be substantially less than the spatial resolution of the front modulator indicated by representation 130. Accordingly, dynamic range extension may be achieved with a sampled low frequency and filtered version of the displayed image. Referring back to FIG. 4B, resolution mapper 458 and the output of mean modulation value generator 456 may collectively provide a low-resolution representation of the rear modulator drive signal.

Luminance enhancer and contrast controller module 460 may receive the output of mean modulation value generator 456, namely $L_{clusters}$. To increase flexibility for rear modulating elements cluster response, luminance enhancement may be provided by 460, and, contrast control may be provided by 460. In some examples, luminance enhancement may be achieved by applying a multiplier to $L_{clusters}$. In other examples, contrast control may be achieved by applying a power function to $L_{clusters}$. To decrease the brightness of the modulating elements, a multiplier m that is less than one may be applied to the drive values in some examples. In other examples, a power p that has a value greater than one may be applied to $L_{clusters}$ to boost contrast. Eq. (7) provides an expression of the application of luminance enhancement and contrast control provided by 460.

$$L_{drive}=m(L^P)_{clusters} \qquad \text{Eq. (7)}$$

Luminance enhancer and contrast controller (module) 460 may provide contrast control and luminance enhancement of the rear modulator in accordance with several techniques. For example, module 460 may generate the rear modulator drive signal indicative of the modulation value intensity image, by adjusting the $L_{clusters}$ to an increased luminance range, and by assigning the $L_{clusters}$ to be the signal that causes one or more modulating elements 146 to generate an image with increased contrast in luminance profile. Storage 462 can be configured to store statistical functions (e.g., Gamma stretching, power functions, scalers, and the like) and look-up tables (LUTs) for use by module 460 in accordance with Eq. (7). In some examples, contrast controller of module 460 may access a LUT to determine the increased luminance range, and storage 462 may conveniently provide LUT values. In other examples, suitable contrast stretching techniques may be use to improve contrast control.

Still referring to FIG. 4B, module 460 may additionally generate the rear modulator drive signals indicative of the modulation value intensity image, by applying a power function to the $L_{drive}$. The power function may adjust a luminance value associated with the rear modulator drive signal to compensate for non-uniform luminance characteristics associated with the rear modulator. In some examples, luminance enhancer of module 460 may access a power function conveniently from storage 462 and or via a LUT. In still further examples, module 460 may generate the rear modulator drive signals $L_{drive}$ indicative by scaling, $mL_{clusters}$, which may be configured to apply a scale factor to control one or more modulating elements 146 to obtain and increased intensity in light emitted. In some examples, module 460 may access the scale factor conveniently from storage 462.

Figure 6:
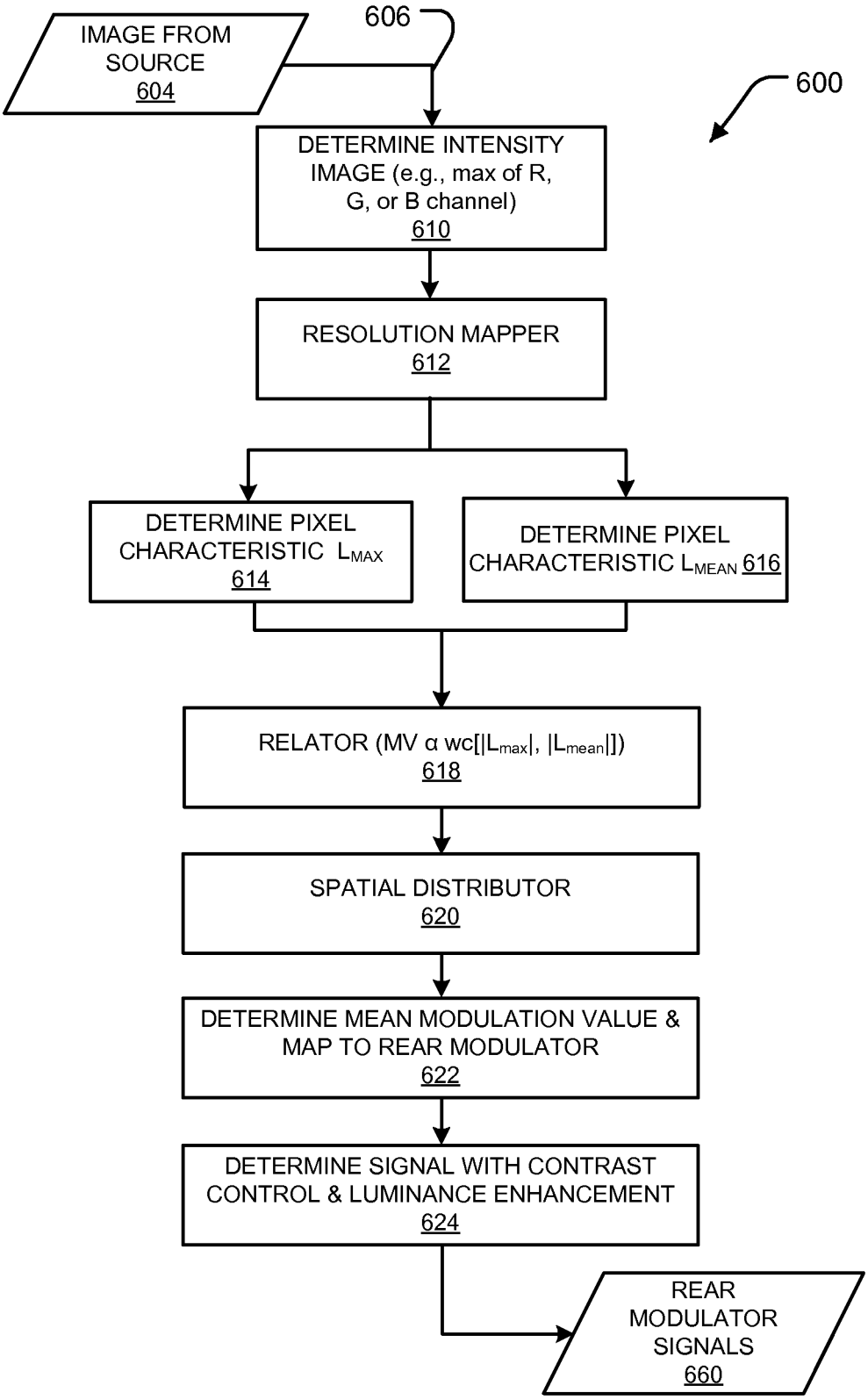
FIG. 6 depicts a flowchart of another method to operate a rear modulator, according to at least some embodiments of the invention.

FIG. 6 depicts a flowchart of another method to operate a rear modulator, according to at least some embodiments of the invention. Here with method 600, input image 604 may include a plurality of pixels. In some examples, input image may be a gamma encoded video signal transmitted on line 606. At 610, a maximum intensity image, $L_{intensity}$, may be determined in accordance with Eq. (1). In some examples, the maximum intensity image may be determined by selecting a maximum of the 3 color channels, R, G, or B, per pixel, and by outputting one color component for the 3 color channels. At 612, this maximum intensity image having a corresponding pixel resolution $R_1$ may be downsampled to a transitional spatial resolution $R_2$ that has a finer granularity than the resolution $R_3$ of the array of modulating elements. In some examples $R_2$ is twice the resolution of $R_3$. At 614, a maximum intensity image $L_{max}$ is determined for a first pixel characteristic in accordance with Eq. (2). At, 616, a mean intensity image $L_{mean}$ is determined for a second pixel characteristic in accordance with Eq. (3). At 618, a modulation value intensity image is determined as a weighted combination intensity image $L_{combo}$ in accordance with Eq. (4). At 620, the weighted combination intensity image is spatially distributed by applying a filter in accordance with Eq. (5) across a set of distributed values, $sv_1$, $sv_2$, . . . , $sv_i$, among a group 510 of sample locations 512, where i>0, to achieve a filtered intensity image $L_{filtered}$. In some examples, a Gaussian filter may be applied to the weighted combination intensity image across the set of distributed values to smooth gradients at the rear modulator. At 622, a mean bilinear downsample may be applied by generator 456 and resolution mapper 458 to smooth the rear modulator low resolution image, as represented by $L_{clusters}(i)$, and in accordance with Eq. (6). At 624, the downsampled mean modulation intensity image may be adjusted in accordance with $L_{drive}$ of Eq. (7) to an increased luminance range to cause the one or more modulating elements to generate an image with increased contrast. Additionally and/or alternatively at 624, a power function may be applied to $L_{clusters}(i)$, to compensate for non-uniform luminance characteristics associated with the rear modulator. Additionally and/or alternatively, at 624, the downsampled mean modulation intensity image may be scaled to control the rear modulator to increase luminance for one or more modulating elements. The output of 624 may be transmitted as the rear modulator signal 660.

Figure 7:
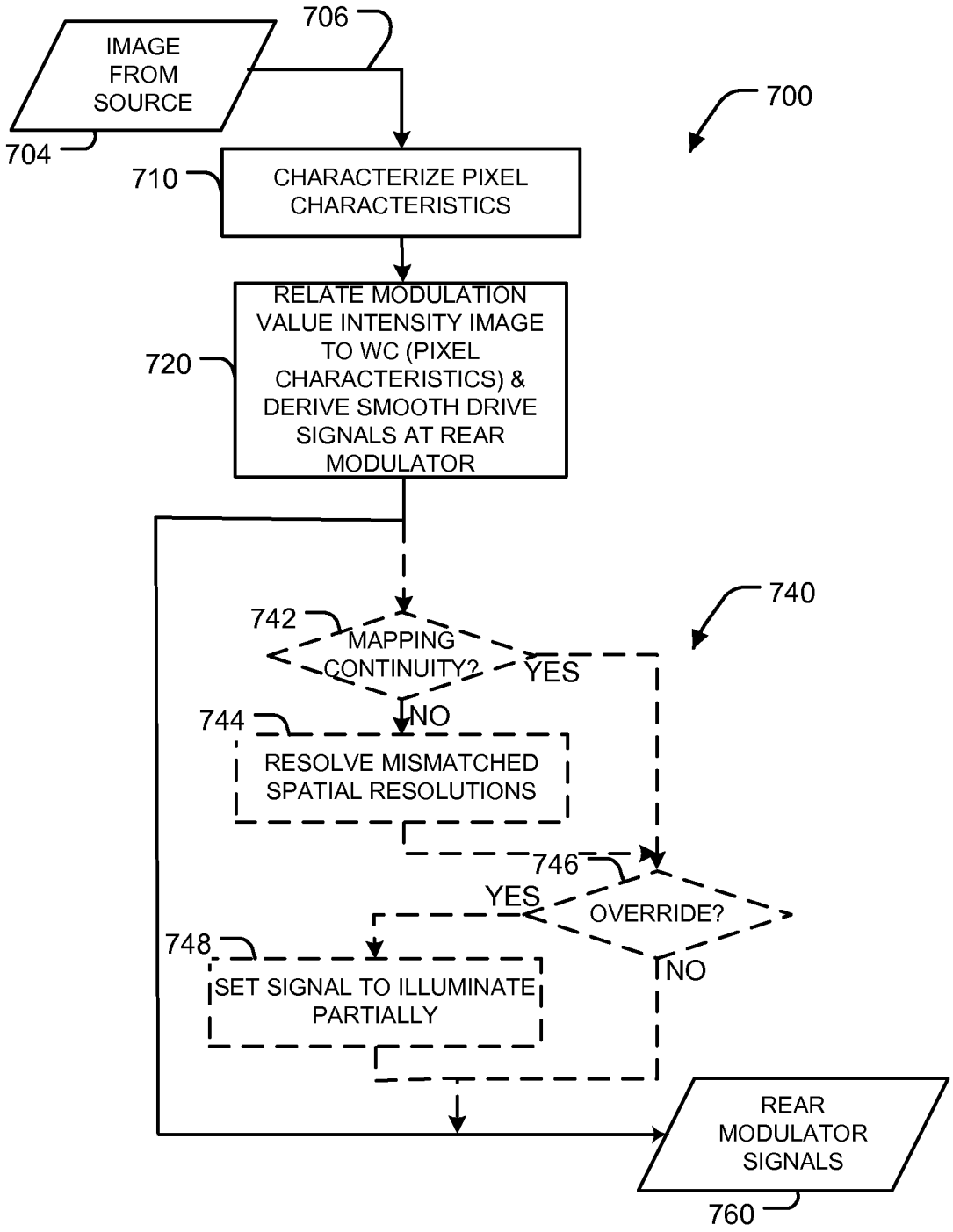
FIG. 7 depicts a flowchart of yet another method to operate a rear modulator, according to at least some embodiments of the invention.

FIG. 7 depicts a flowchart of yet another method to operate a rear modulator, according to at least some embodiments of the invention. Here, method 700 includes 710 and 720, which are similar to 210 and 220, respectively of FIG. 2. For example, an input image 704 from an image source may be a gamma-encoded video stream transmitted on line 706. At 710, pixel characteristics may be identified. At 720, a modulation value intensity image may be derived based on $L_{combo}$ to form rear modulation drive signals. Rear modulation signals 760 indicative of the modulation value that may be applied to the rear modulator intensity image to control one or more modulating elements 146 to generate a low resolution image.

Still referring to FIG. 7, method 740 is optional and is shown in dashed lines. At 742, a mismatch may be determined between the spatial resolution $R_3$ corresponding to the rear modulator and either the spatial resolution $R_1$ corresponding to the front modulator or the transitional spatial resolution $R_2$. Referring to FIG. 1, an example of a mismatch in spatial resolution may arise when downsampling from either $R_1$ or $R_2$, both of which may, by way of examples, correspond to a quadrilateral-shape grid pattern, to $R_3$, which corresponds to a hexagonal-shape grid pattern 144. In this situation, at 742, mapping continuity would not be confirmed due to a detection of the mismatch in spatial resolution between an arrangement associated with quadrilateral-shape grid and an arrangement associated with a hexagonal-shape grid. At 744, the mismatch in spatial resolution may be resolved to illuminate an image portion at the rear modulator that is associated with the group of pixels 134. This allows corresponding features that otherwise would be lost due to the mismatch of grid configurations to be preserved. In some examples, resolving the mismatch in spatial resolution may include reconfiguring one of the arrangements of mismatched grid configurations so as to match the other. In doing so, where mismatched locations are added or inserted into the reconfigured grid (or arrangement of samples) in order to match the other grid configuration, the value of the first pixel characteristic may be assigned to these added mismatched locations so that the spatial resolution of the reconfigured grid and the other grid match. In some examples, although a hexagonal-shape grid, having a pattern of offset rows of modulating elements 142, has been mentioned; it may be appreciated that in other examples, there may be a variety of other spatial resolution that may result in a mismatched spatial resolution when downsampling. In those situations, other suitable techniques for resolving such mismatch may be employed.

At 746, an assumption may be made that 710 and 720 have included flow similar to the flow of FIG. 6 up until 624. At 746, should the $L_{drive}$ value be zero, this may be an indication that the rear modulator should be controlled to display a dark image because the input image probably was a dark image. However, if the maximum intensity image $L_{max}$ is non-zero, indicating that there are small features in darker regions represented by the group of pixels 134, then 746 detects that such features have failed to be adequately preserved for display on the rear modulator, and that an override signal should be generated. In this example, at 748, responsive to an override condition detected in 746, an alternative signal may be generated to enable a minimum illumination of one or more modulating elements to allow small features in darker regions, represented by an image portion within a group of pixels 134, to be displayed in the image at the rear modulator. In some examples, the alternative signal may cause one or more of the modulating elements 146 to illuminate partially so that the appearance of such small features in darker regions are preserved in the low resolution image displayed at the rear modulator. In other examples, a determination may be made that at least one pixel in a sampled group is associated with an intensity that exceeds a threshold intensity, while another determination may be made that the other pixels in the sampled group are associated with intensity below the threshold. When these conditions are met, a light source, such as one or more modulating elements associated with the sample group of pixels, may be activated at a minimum intensity.

Figure 8:
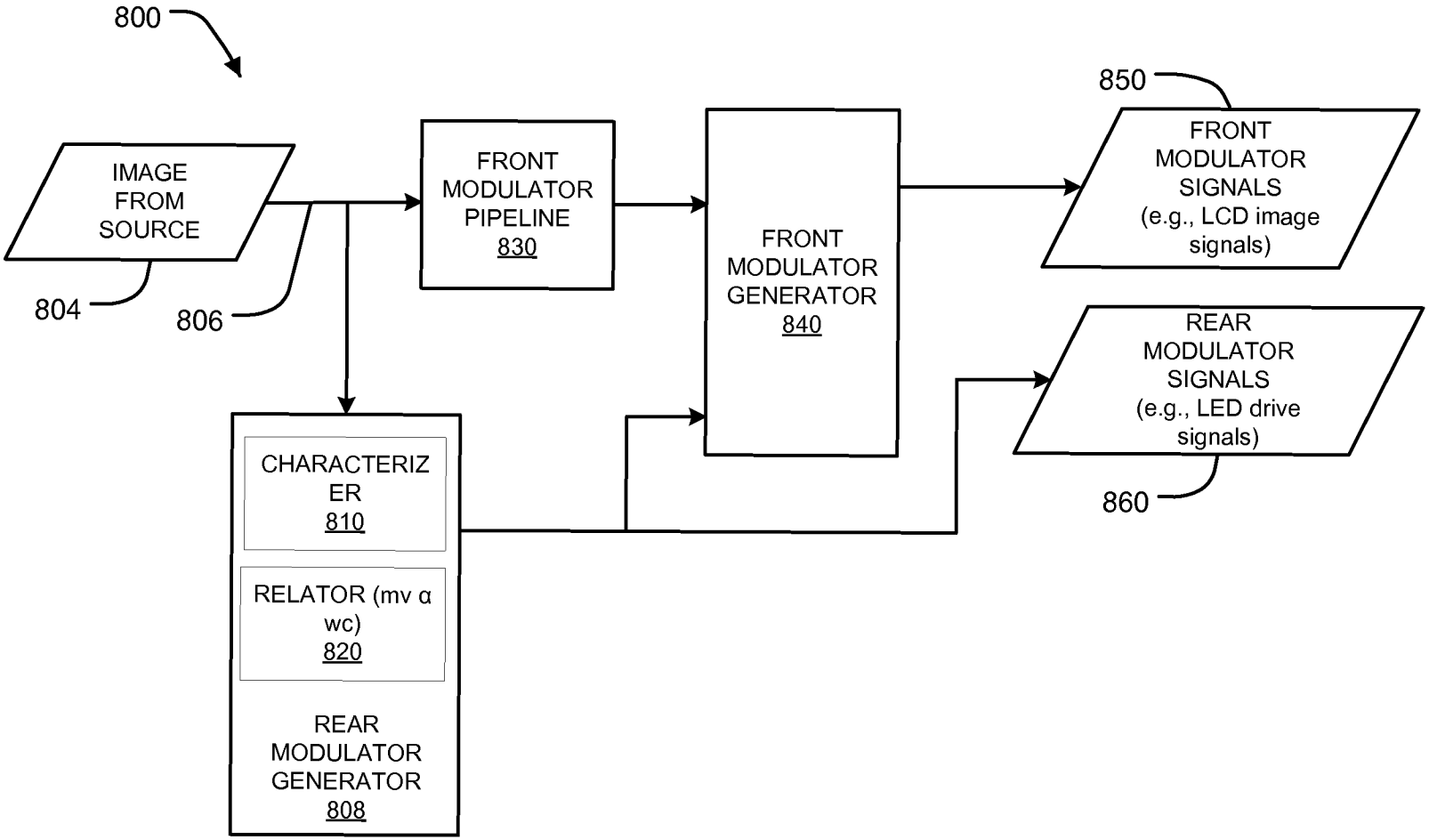
FIG. 8 is a block diagram of an exemplary display controller to operate front and rear modulators.

FIG. 8 is a block diagram of an exemplary display controller to operate front and rear modulators. Here, display controller 800 includes a rear modulator generator 808, front modulator pipeline 830, and front modulator generator 840. Rear modulator generator includes characterizer 810 and relator 820, both configured to provide the respective functions described herein. Input image 804 may be provided as gamma-encoded images on line 806 in some examples to both rear modulator generator 808 and front modulator pipeline 830. Rear modulator generator 808 may generate rear modulator drive signals 860 to control the operation of a rear modulator. That is, deriving from content from input image 804 and using the methods, techniques and description provided herein, appropriate driving levels for each modulating element of a rear modulator may be determined. Front modulator generator 840 may generate front modulator signals 850 to control the operation of a front modulator, based upon input from front modulator pipeline 830, and rear modulator drive signals. Front modulator pipeline 830 includes the generation of front modulator output values that produce the desired overall light output and white point. For example, pipeline 830 may apply color correction techniques, dividing the values by a light simulation output, correcting for gamut and front modulator response. The input image 804 may be adjusted to an optimal display on a front modulator given the corresponding light field.

Figure 9:
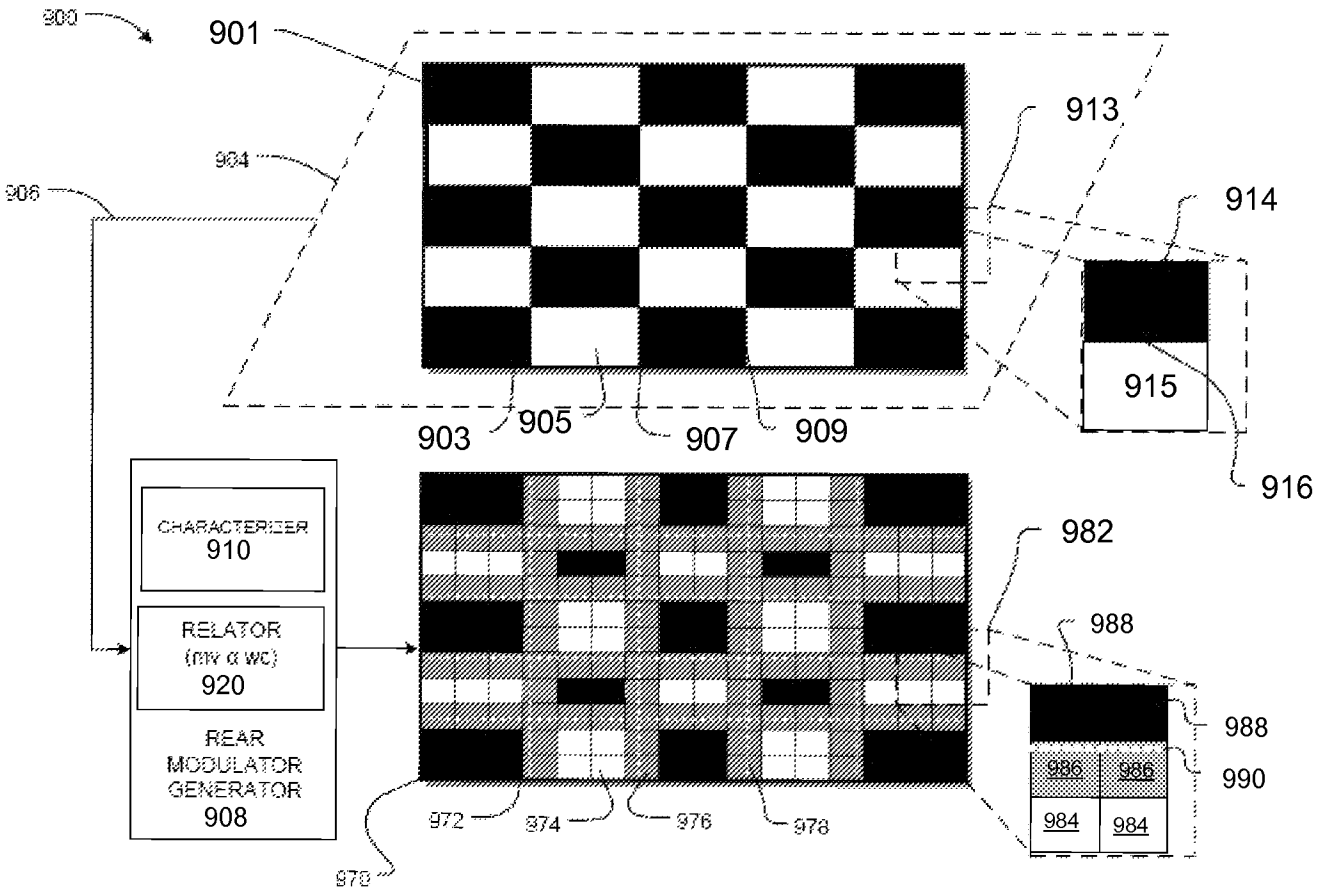
FIG. 9 depicts an example of controlling rear modulating elements, according to at least some embodiments of the invention.

FIG. 9 depicts an example of controlling rear modulating elements, according to at least some embodiments of the invention. Diagram 900 includes an input image 904 that is configured to be received by rear modulator generator 908, which in turn may be configured to generate rear modulator drive signals to operate rear modulator 970. In some examples, input image 904 includes images directed towards an ANSI checkboard pattern 901. Pattern 901 includes dark regions 903, bright regions 905, dark regions near an interface 907, and interfaces 909. Rear modulator generator 908 includes characterizer 910 and relator 920 that have been described previously. Rear modulator 970 includes a plurality of modulating elements, including: element 972 that has zero intensity (e.g., dark); element 974 that has been illuminated to a bright intensity; and element 976 that has been illuminated to an intensity greater than element 972 but less that element 974. Element 972 may not be illuminated, thus, approximating a dark pattern 903. Element 974 can be illuminated at a maximum intensity, thus approximating a white pattern 905. Element 976 may be partially illuminated to enable a dark region 907 near an interface (with a bright intensity). Interface 978 is in between a partially illuminated modulating element and corresponds to interface 909. Cutaway 913 depicts an exploded view of dark block 914 and white block 915, with an interface 916 situated there between. At rear modulator 970, cutaway 982 shows modulating elements 984 illuminated at a maximum intensity to recreate white block 915. Modulating elements 988 are programmed to be in a dark state (i.e., not illuminated) to recreate block 914 in cutaway 913. Modulating elements 986 are programmed to be illuminated at an intensity at interface 990 configured to recreate interface 916 of cutaway 913.

Although in some examples, three levels of resolution have been described as $R_1>R_2>R_3$, in other examples, it may be appreciated that two levels of resolution may be used to achieve similar results.

Additionally, as used herein, the term first display may be used interchangeably to refer to a front modulator and a display layer. In some examples, the first display may include, but is not limited to an LCD panel, LCD modulator, projection-type display modulators, active matrix LCD (AMLCD) modulators, and other devices that modulates a light and/or image signal. The term second display may be used interchangeably with the term rear modulator, and (modulated) light source layer. In some examples, the second display may include, but is not limited to a backlight display having an array of controllable LEDs or organic LEDs (OLEDs). In other examples, the second display may include a fixed-intensity light source such as a plurality of fluorescent light sources, a low-resolution projector, a light modulator disposed to spatially modulate the intensity of light from the light source, and combination of these. A display device may have both front and rear modulators, such as an HDR display.

As used herein, the term signal may be used interchangeably with rear modulator drive signal, and rear modulator drive level. In some examples, an LED drive level refers to a signal applied to an array of LEDs at the rear modulator.

By way of examples, reference to a high spatial resolution ($R_1$) may include a spatial resolution of 1920×1080×1×10 bits. Reference to a low spatial resolution ($R_3$) may include a resolution based on an array of [a×b] modulating elements, where a<1920 bits, and b<1080 bits, by way of examples, Reference to a transitional spatial resolution ($R_2$) may include a resolution based on a [2a×2b] array of image blocks, by way of examples.

By way of examples, reference to bright regions of an image may refer, at the front modulator, to a luminance of approximately 300 cd/m$^2$; whereas reference to dark regions of an image may refer, at a front modulator, to a black level of approximately 1 cd/m$^2$.

Reference to a power function may include, but is not limited to, Eq. (8).

$$f(x)=2.0*(x\hat{}((2.2+\text{boost})/2)),\ \text{where } 0\leq x\leq 1. \qquad \text{Eq. (8)}$$

As examples, the described method, techniques, processes, apparatus' and computer-medium products and systems may be implemented in a variety of applications, including, but not limited to, HDR displays, displays of portable computers, digital clocks, watches, appliances, electronic devices, audio-visual devices, medical imaging systems, graphic arts, televisions, projection-type devices.

In some embodiments, the functions and/or sub-processes may be performed by any structure described herein.

In some examples, the methods, techniques and processes described herein may be performed and/or executed by software instructions on computer processors. For example, one or more processors in a computer or other display controller may implement the methods of FIGS. 2, 4A-B, and 6-7, by executing software instructions in a program memory (e.g., storage/memory of FIGS. 3 and 4B) accessible to a processor. Additionally, the methods, techniques and processes described herein may be performed with full frame images using a graphics processing unit (GPU) or a control computer, or field-programmable gate array (FPGA) coupled to the display. These methods, techniques and processes may also be provided in the form of a program product, which may comprise any medium which carries a set of computer-readable instructions which, when executed by a data processor, cause the data processor to execute such methods, techniques and/or processes. Program products, may include, but are not limited to: physical media such as magnetic data storage media, including floppy diskettes, and hard disk drives; optical data storage media including CD ROMs, and DVDs; electronic data storage media, including ROMs, flash RAM, non-volatile memories, thumb-drives, or the like; and transmission-type media, such as digital or analog communication links, virtual memory, hosted storage over a network or global computer network, and networked-servers.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques, including C, Objective C, C++, C#, Flex™, Fireworks®, Java™, Javascript™, AJAX, COBOL, Fortran, ADA, XML, HTML, DHTML, XHTML, HTTP, XMPP, Ruby on Rails, and others. These can be varied and are not limited to the examples or descriptions provided.

Various embodiments or examples of the invention may be implemented in numerous ways, including as a system, a process, an apparatus, or a series of program instructions on a computer readable medium such as a computer readable storage medium or a computer network where the program instructions are sent over optical, electronic, or wireless communication links. In general, operations of disclosed processes may be performed in an arbitrary order, unless otherwise provided in the claims.

A detailed description of one or more examples is provided herein along with accompanying figures. The detailed description is provided in connection with such examples, but is not limited to any particular example. The scope is limited only by the claims, and numerous alternatives, modifications, and equivalents are encompassed. Numerous specific details are set forth in the description in order to provide a thorough understanding. These details are provided as examples and the described techniques may be practiced according to the claims without some or all of the accompanying details. They are not intended to be exhaustive or to limit the invention to the precise forms disclosed, as many alternatives, modifications, equivalents, and variations are possible in view of the above teachings. For clarity, technical material that is known in the technical fields related to the examples has not been described in detail to avoid unnecessarily obscuring the description.

Enumerated Example Embodiment 1 (EEE1). A method to operate a rear modulator, the method comprising:

characterizing a group of pixels to form a first pixel characteristic and a second pixel characteristic as data-reduced representations of the group of pixels;

determining a modulation value intensity image for a group of sample locations based on the first pixel characteristic and the second pixel characteristic, a number associated with the group of sample locations being fewer than a number associated with the group of pixels; and applying a signal indicative of the modulation value intensity image to control one or more modulating elements to generate an image at the rear modulator, a number associated with the one or more modulating elements being fewer than the number associated with the group of sample locations.

EEE2. The method of claim 1, wherein characterizing a group of pixels comprises:

establishing a maximum intensity image and a mean intensity image as the first pixel characteristic and the second pixel characteristic, respectively.

EEE3. The method of claim 1, wherein determining a modulation value intensity image comprises:

generating a weighted combination intensity image based on the first pixel characteristic and the second pixel characteristic;

spatially-distributing the weighted combination intensity image among the group of sample locations to form at least a set of distributed values; and calculating the modulation value intensity image as a function of at least a subset of the set of distributed values.

EEE4. The method of claim 3, wherein calculating the modulation value intensity image comprises:

determining a mean intensity image for the set of distributed values.

EEE5. The method of claim 3, further comprising:

filtering the group of sample locations to mitigate spatial aliasing artifacts.

EEE6. The method of claim 1, further comprising:

establishing a maximum intensity image as the first pixel characteristic;

determining that at least one pixel in the group of pixels is associated with an intensity that exceeds a threshold intensity, and that other pixels in the group of pixels are associated with intensities that are below the threshold intensity; and activating a light source associated with the group of pixels to generate a minimum intensity, wherein the threshold intensity specifies whether to illuminate the light source.

EEE7. The method of claim 6, further comprising:

overriding the signal with an alternative signal that is configured to enable an image portion associated with the at least one pixel to be displayed in the image at the rear modulator.

EEE8. The method of claim 1, further comprising:

determining a mismatch in spatial resolution between the one or more modulating elements and either the group of pixels or the group of sample locations; and resolving the mismatch in spatial resolution to illuminate an image portion associated with the group of pixels.

EEE9. The method of claim 8, wherein resolving the mismatch in spatial resolution comprises:

reconfiguring a first arrangement to match a second arrangement, the first arrangement being associated with either the group of pixels or the group of sample locations, the first arrangement having a first spatial resolution, the second arrangement being associated with the one or more modulating elements and having a second spatial resolution, mismatched locations being inserted into the first arrangement when reconfigured; and assigning the first pixel characteristic to the mismatched locations, so that the first spatial resolution matches the second spatial resolution.

EEE10. The method of claim 9, further comprising:

adjusting the first arrangement to match the second arrangement, wherein the first arrangement has a quadrilateral-shape, and the second arrangement has a hexagonal-shape.

The method of claim 1, wherein the one or more modulating elements comprise one or more LED elements.

EEE11. The method of claim 1, wherein applying the signal comprises:

generating the signal to control a backlight display modulator as the modulator.

EEE12. The method of claim 1, wherein the group of pixels comprise gamma-encoded image pixels derived from an input image.

EEE13. The method of claim 1, wherein characterizing a group of pixels comprises:

establishing a maximum intensity image corresponding to the group of pixels, wherein the maximum intensity image includes a color channel being a maximum of a plurality of color channels that are a function of a gamma-encoded video signal.

EEE14. A computer readable medium to facilitate operation of a rear modulator having one or more modulating elements, the computer readable medium comprising executable instructions operable on a processor to:

characterize a group of pixels to form a first pixel characteristic and a second pixel characteristic as data-reduced representations of the group of pixels; and, generate a modulation value intensity image for a group of sample locations based on a weighted combination intensity image of the first pixel characteristic and the second pixel characteristic, the modulation value intensity image being configured to cause the processor to control operation of the one or more modulating elements to generate an image at the rear modulator.

EEE15. The computer readable medium of claim 15, further comprising executable instructions to:

define the first pixel characteristic as a maximum intensity image corresponding to an image portion in a subset of pixels in the group of pixels, the subset of pixels located adjacent other pixels in the group of pixels that have intensities that are substantially zero.

EEE16. The computer readable medium of claim 15, further comprising executable instructions to:

define the second pixel characteristic as a mean intensity image representing an attenuation of an output of the one or more modulating elements.

EEE17. The computer readable medium of claim 15, further comprising executable instructions to:

provide an override signal configured to activate a light source to provide a minimal level of intensity to display an image portion in a subset of pixels that otherwise would not be illuminated based on intensities of other pixels in the group of pixels.

EEE18. The computer readable medium of claim 15, further comprising executable instructions to:

determine a mismatch in spatial resolution between the one or more modulating elements and either the group of pixels or the group of sample locations; and resolve the mismatch in spatial resolution to illuminate a portion of the image associated with the group of pixels.

EEE19. The computer readable medium of claim 19, further comprising executable instructions to:

detect the mismatch in spatial resolution between a hexagonal-shape spatial resolution and a quadrilateral-shape spatial resolution.

EEE20. The computer readable medium of claim 15, further comprising executable instructions to:

downsample an intensity image having a first resolution to another intensity image having a second resolution, the first resolution being associated with the group of pixels and the second resolution being associated with the group of sample locations, the second resolution being lower the than the first resolution.

EEE21. The computer readable medium of claim 15, further comprising executable instructions to:

generate data representing the weighted combination intensity image of the first pixel characteristic and the second pixel characteristic.

EEE22. The computer readable medium of claim 22, further comprising executable instructions to:

define the weighted combination intensity image (wc) according to an equation, $$wc=j\times(\text{the first pixel characteristic})+k\times(\text{the second pixel characteristic}),\ \text{where } j+k=1.$$

EEE23. The computer readable medium of claim 23, further comprising executable instructions to:

spatially-distribute the weighted combination intensity image among the group of sample locations to form at least a set of distributed values.

EEE24. The computer readable medium of claim 24 further comprising executable instructions to:

spatially-distribute the weighted combination intensity image by filtering the at least a set of distributed values.

EEE25. The computer readable medium of claim 24, further comprising executable instructions to:

calculate the modulation value intensity image as a mean value intensity image of at least a subset of the set of distributed values.

EEE26. The computer readable medium of claim 26, further comprising executable instructions to:

downsample the modulation value intensity image from a first resolution associated with the group of sample locations to another intensity image having a second resolution associated with the one or more modulating elements, wherein the second resolution is lower than the first resolution.

EEE27. The computer readable medium of claim 26, further comprising executable instructions to:

adjust the modulation value intensity image to an increased luminance range; and assign the modulation value intensity image to a signal to cause the one or more modulating elements to illuminate with increased contrast.

EEE28. The computer readable medium of claim 28, further comprising executable instructions to:

access a look-up-table ("LUT") to determine the increased luminance range.

EEE29. The computer readable medium of claim 26, further comprising executable instructions to:

apply a power function to the modulation value intensity image to generate a signal, wherein the power function scales an intensity associated with the signal to compensate for non-uniform luminance characteristics associated with the rear modulator.

EEE30. The computer readable medium of claim 26, further comprising executable instructions to:

scale the modulation value intensity image to generate a signal, wherein the signal is operable to apply the scale to illuminate the one or more modulating elements with increased intensity.

EEE31. The computer readable medium of claim 15, further comprising executable instructions to:

establish a maximum intensity image corresponding to the group of pixels, wherein the maximum intensity image includes a color channel being a maximum of a plurality of color channels that are a function of a gamma-encoded video signal.

EEE32. A controller, comprising:

a first module communicatively coupled to a processor along a bus, the processor configured to receive an input image having a plurality of pixels, the first module configured to characterize a group of pixels to form a first pixel characteristic and a second pixel characteristic as data-reduced representations of the group of pixels;

a second module communicatively coupled to the bus, the second module configured to relate the first pixel characteristic and the second pixel characteristic in weighted combination to a modulation value intensity image generated for a group of sample locations, the modulation value intensity image being operable to derive a signal by the processor; and, a modulator interface configured to transmit the signal.

EEE33. The controller of claim 33, wherein the first pixel characteristic comprises a maximum intensity image.

EEE34. The controller of claim 33, wherein the second pixel characteristic comprises a mean intensity image.

EEE35. The controller of claim 33, further comprising:

a display device having a rear modulator configured to be communicatively coupled to the modulator interface and to receive the signal, the rear modulator including a plurality of modulating elements, wherein one or more of the plurality of modulating elements becomes operable responsive to receiving the signal.

EEE36. The controller of claim 36, further comprising:

a front modulator interface communicatively coupled to the bus, wherein the display device further includes a front modulator configured to be communicatively coupled to the front modulator interface.

EEE37. The controller of claim 37, wherein the front modulator comprises an LCD modulator.

EEE38. The controller of claim 36, wherein the display device comprises a high dynamic range (HDR) display.

EEE39. The controller of claim 36, wherein the rear modulator comprises a backlight display modulator, and the plurality of modulating elements comprises a plurality of light-emitting diodes (LEDs).

EEE40. The controller of claim 36, further comprising:

an ancillary module communicatively coupled to the bus, wherein responsive to the modulation value intensity image varying from a representation of the first pixel characteristic, the ancillary module generates an override signal configured to enable small features in dark regions to be represented by the group of pixels to be displayed on the rear modulator.

EEE41. The controller of claim 36, further comprising:

an ancillary module communicatively coupled to the bus, wherein responsive to a determination of a mismatch in spatial resolution between the one or more of the plurality of modulating elements and either the group of pixels or the group of sample locations, the ancillary module resolves the mismatch in spatial resolution to prevent features represented by the group of pixels from being lost when an image is generated at the rear modulator.

EEE42. The controller of claim 33, further comprising:

a gamma-encoded video signal providing the plurality of pixels that form the input image.

The description, for purposes of explanation, uses specific nomenclature to provide a thorough understanding of the invention. However, it will be apparent that specific details are not required in order to practice the invention. In fact, this description should not be read to limit any feature or aspect of the present invention to any embodiment; rather, features and aspects of one example can readily be interchanged with other examples. Notably, not every benefit described herein need be realized by each example of the present invention; rather, any specific example may provide one or more of the advantages discussed above. In the claims, elements and/or operations do not imply any particular order of operation, unless explicitly stated in the claims. It is intended that the following claims and their equivalents define the scope of the invention.

What is claimed:

1. A method comprising the steps of:

receiving an input image having a plurality of pixels;

grouping the pixels to corresponding sample locations;

determining a maximum intensity and a mean intensity of the pixels in each sample location;

generating, for each sample location, a weighted sum intensity from the maximum intensity and the mean intensity of the pixels in the sample location;

grouping the sample locations such that each group of sample locations corresponds to one or more modulating elements of the rear modulator;

determining a modulation value for each group of sample locations based on the weighted sum intensity of the sample locations of the corresponding group of sample locations, except that, when at least one pixel in a group of pixels is associated with an intensity that exceeds a threshold intensity, and when other pixels in the group of pixels are associated with intensities that are below the threshold intensity, the modulation value associated with the group of pixels is set to a minimum intensity;

applying a signal indicative of the modulation value to control one or more modulating elements of the rear modulator to generate an image at the rear modulator;

determining a mismatch in spatial resolution between the one or more modulating elements and either the group of pixels or the group of sample locations; and reconfiguring a first arrangement to match a second arrangement, the first arrangement being associated with either the group of pixels or the group of sample locations, the first arrangement having a first spatial resolution, the second arrangement being associated with the one or more modulating elements and having a second spatial resolution, mismatched locations being inserted into the first arrangement when reconfigured, thereby resolving the mismatch in spatial resolution to illuminate an image portion associated with the group of pixels.

2. The method of claim 1, wherein the modulation value for each group of sample locations is determined by calculating the mean value of the weighted sum intensities of the sample locations of the group of sample locations.

3. The method of claim 1, further comprising:

filtering the group of sample locations to mitigate spatial aliasing artifacts.

4. The method of claim 1, further comprising:

overriding the signal with an alternative signal that is configured to enable an image portion within the group of pixels associated with the at least one pixel to be displayed in the image at the rear modulator.

5. The method of claim 1, further comprising:

adjusting the first arrangement to match the second arrangement, wherein the first arrangement has a quadrilateral-shape, and the second arrangement has a hexagonal-shape.

6. The method of claim 1, wherein the group of pixels comprise gamma-encoded image pixels derived from the input image.

7. The method of claim 1, wherein the maximum intensity image includes a color channel being a maximum of a plurality of color channels that are a function of a gamma-encoded video signal.

8. The method according to claim 1, wherein the method is part of a dual modulation High Dynamic Range display configured to operate on a gamma encoded video stream.

9. The method according to claim 1, wherein the method is operative on a gamma encoded video stream.

10. The method according to claim 1, wherein the method comprises operating a dual modulation display comprising backlights arranged in clusters.

11. The method according to claim 1, wherein the method comprises operating a projection display.

12. The method according to claim 1, wherein the method comprises operating a projection display comprising narrow-band light sources.

13. A controller, comprising:

a first module communicatively coupled to a processor along a bus, the processor configured to receive an input image having a plurality of pixels, the first module configured to group pixels of the input image into sample locations and to determine a maximum intensity and mean intensity for each sample location;

a second module communicatively coupled to the bus, the second module configured to relate the maximum intensity and the mean intensity in a weighted sum to a modulation value intensity image generated for a group of sample locations, each group of sample locations corresponding to one or more modulating elements, the modulation value intensity image being operable to derive a signal by the processor;

a modulator interface configured to transmit the signal; and an ancillary module communicatively coupled to the bus, wherein responsive to the modulation value intensity image varying from a representation of the maximum intensity image, the ancillary module generates an override signal configured to enable small features in dark regions to be represented by the group of pixels to be displayed on a rear modulator; and wherein the modules are together configured to determine a mismatch in spatial resolution between the one or more modulating elements and either the group of pixels or the group of sample locations, reconfigure a first arrangement to match a second arrangement, the first arrangement being associated with either the group of pixels or the group of sample locations, the first arrangement having a first spatial resolution, the second arrangement being associated with the one or more modulating elements and having a second spatial resolution, mismatched locations being inserted into the first arrangement when reconfigured, and thereby resolve the mismatch in spatial resolution to illuminate an image portion associated with the group of pixels.

14. The controller of claim 13, further comprising:

a display device having the rear modulator communicatively coupled to the modulator interface and configured to receive the signal, the rear modulator including a plurality of modulating elements, wherein one or more of the plurality of modulating elements becomes operable responsive to receiving the signal.

15. The controller of claim 14, wherein responsive to a determination of a mismatch in spatial resolution between the one or more of the plurality of modulating elements and either the group of pixels or the group of sample locations, the ancillary module resolves the mismatch in spatial resolution to prevent features represented by the group of pixels from being lost when an image is generated at the rear modulator.

16. The controller according to claim 13, wherein the controller is installed in a dual modulation High Dynamic Range display configured to operate on a gamma encoded video stream.

17. The controller according to claim 13, wherein the controlled is configured to be operative on a gamma encoded video stream.

18. The controller according to claim 13, wherein the controller is configured to operate a dual modulation display comprising backlights arranged in clusters.

19. The controller according to claim 13, wherein the controller is disposed in a projection display.

20. The controller according to claim 13, wherein the controller is disposed in a projection display comprising narrow-band light sources.

* * * * *